US008297373B2

(12) United States Patent
Elger et al.

(10) Patent No.: US 8,297,373 B2
(45) Date of Patent: Oct. 30, 2012

(54) IMPACT DEVICE

(75) Inventors: William A. Elger, West Bend, WI (US); Jeremy R. Ebner, Milwaukee, WI (US)

(73) Assignee: Milwaukee Electric Tool Corporation, Brookfield, WI (US)

( * ) Notice: Subject to any disclaimer, the term of this patent is extended or adjusted under 35 U.S.C. 154(b) by 77 days.

(21) Appl. No.: 13/029,885

(22) Filed: Feb. 17, 2011

(65) Prior Publication Data

US 2011/0203824 A1 Aug. 25, 2011

Related U.S. Application Data

(60) Provisional application No. 61/306,016, filed on Feb. 19, 2010.

(51) Int. Cl.
*B25D 11/04* (2006.01)

(52) U.S. Cl. ..... 173/94; 173/90; 173/100; 173/117; 173/93; 173/109; 173/217; 173/122; 173/205

(58) Field of Classification Search ..... 173/94, 173/90, 100, 117, 93, 109, 217, 122, 205
See application file for complete search history.

(56) References Cited

U.S. PATENT DOCUMENTS

| | | | |
|---|---|---|---|
| 608,555 | A | 8/1898 | Nazel |
| 1,341,534 | A | 5/1920 | Covert |
| 1,341,545 | A | 5/1920 | Covert |
| 1,366,850 | A | 1/1921 | Trotter |
| 1,579,840 | A | 4/1926 | Rasch |
| 1,694,284 | A | 12/1928 | Santa Ana |
| 1,725,212 | A | 8/1929 | Schneider |
| 1,738,207 | A | 12/1929 | Riggs |
| 1,860,826 | A | 5/1932 | Tschudi |
| 2,002,762 | A | 5/1935 | Badcon |
| 2,079,909 | A | 5/1937 | Jackson |
| 2,160,150 | A | 5/1939 | Jimerson et al. |
| 2,196,589 | A | 4/1940 | Jimerson |
| 2,500,402 | A | 3/1950 | Craig |

(Continued)

FOREIGN PATENT DOCUMENTS

CN 2601790 Y 2/2004

(Continued)

OTHER PUBLICATIONS

PCT/US2011/025288 International Search Report and Written Opinion dated Oct. 28, 2011 (9 pages).

(Continued)

*Primary Examiner* — Brian D Nash
*Assistant Examiner* — Michelle Lopez
(74) *Attorney, Agent, or Firm* — Michael Best & Friedrich LLP

(57) ABSTRACT

An impact device includes a housing, a motor supported by the housing, a stationary shaft, and a rotating transmission member supported on the stationary shaft for rotation. The rotating transmission member includes a hub having a first cam surface. The impact device also includes a rotating impact member carried by the transmission member and rotatable relative to the transmission member. The rotating impact member includes a lug protruding from an outer periphery of the rotating impact member and a second cam surface. The impact device further includes a spherical element engaged with the first and second cam surfaces on the hub of the rotating transmission member and the rotating impact member, respectively, an energy-absorbing member exerting a biasing force against the rotating impact member, and a reciprocating impact member oriented substantially normal to the stationary shaft and impacted by the lug of the rotating impact member.

20 Claims, 11 Drawing Sheets

U.S. PATENT DOCUMENTS

| | | | |
|---|---|---|---|
| 2,539,678 | A | 1/1951 | Thomas |
| 2,745,528 | A | 5/1956 | Amtsberg |
| 2,877,820 | A | 3/1959 | Ristow |
| 2,940,565 | A | 6/1960 | Schodeberg |
| 3,160,217 | A | 12/1964 | Raile |
| 3,160,274 | A | 12/1964 | Pritchard |
| 3,207,237 | A | 9/1965 | Wanner |
| 3,369,615 | A | 2/1968 | Maffey, Jr. et al. |
| 3,376,940 | A | 4/1968 | Willis |
| 3,480,089 | A | 11/1969 | Siddons et al. |
| 3,486,569 | A | 12/1969 | Sieber |
| 3,850,255 | A | 11/1974 | Koehler |
| 3,924,692 | A | 12/1975 | Saari |
| 3,979,040 | A | 9/1976 | Denin |
| 4,042,036 | A | 8/1977 | Smith et al. |
| 4,082,152 | A | 4/1978 | Whitworth |
| 4,114,699 | A | 9/1978 | Wolf |
| 4,161,272 | A | 7/1979 | Brockl |
| 4,299,021 | A | 11/1981 | Williams |
| 4,318,446 | A | 3/1982 | Livesay |
| 4,511,074 | A | 4/1985 | Kille et al. |
| 4,529,044 | A | 7/1985 | Klueber et al. |
| 4,625,093 | A | 11/1986 | Chryssolouris |
| 4,732,217 | A | 3/1988 | Bleicher et al. |
| 4,742,875 | A | 5/1988 | Bell |
| 4,770,254 | A | 9/1988 | Kominami |
| 4,908,909 | A | 3/1990 | Akrenius |
| 4,953,774 | A | 9/1990 | Lai |
| 5,002,134 | A | 3/1991 | Yamada |
| 5,025,869 | A | 6/1991 | Terunuma et al. |
| 5,074,433 | A | 12/1991 | Tachihara et al. |
| 5,152,445 | A | 10/1992 | Furutsu |
| 5,305,672 | A | 4/1994 | Balint |
| 5,320,270 | A | 6/1994 | Crutcher |
| 5,361,853 | A | 11/1994 | Takamura et al. |
| 5,443,196 | A | 8/1995 | Burlington |
| 5,605,271 | A | 2/1997 | Russell |
| 5,794,325 | A | 8/1998 | Fallandy |
| 5,875,950 | A | 3/1999 | Nuss et al. |
| 5,992,538 | A | 11/1999 | Marcengill et al. |
| 6,172,472 | B1 | 1/2001 | Klingbeil |
| 6,213,222 | B1 | 4/2001 | Banach |
| 6,250,401 | B1 | 6/2001 | Yamada |
| 6,308,879 | B1 | 10/2001 | Wang |
| 6,408,951 | B1 | 6/2002 | Lin |
| 6,481,509 | B1 | 11/2002 | Yamane et al. |
| 6,499,643 | B1 | 12/2002 | Hewitt |
| 6,604,666 | B1 | 8/2003 | Pedicini et al. |
| 6,805,272 | B1 | 10/2004 | Sen-Mu et al. |
| 6,866,226 | B2 | 3/2005 | Pratt et al. |
| 6,907,943 | B2 | 6/2005 | Ikuta |
| 6,959,478 | B2 | 11/2005 | Chen |
| 6,997,367 | B2 | 2/2006 | Hu |
| 7,036,608 | B2 | 5/2006 | Garvey et al. |
| 7,104,432 | B2 | 9/2006 | Sun |
| 7,124,839 | B2 | 10/2006 | Furuta et al. |
| 7,201,303 | B2 | 4/2007 | Leimbach |
| 7,263,920 | B1 | 9/2007 | Hamilton |
| 7,306,047 | B2 | 12/2007 | Oda et al. |
| 7,350,592 | B2 | 4/2008 | Hahn et al. |
| 7,588,093 | B2 | 9/2009 | Grand et al. |
| 7,789,282 | B2 | 9/2010 | Fukinuki et al. |
| 7,963,430 | B2 | 6/2011 | Fukinuki et al. |
| 2001/0010268 | A1 | 8/2001 | Tokunaga et al. |
| 2002/0079111 | A1 | 6/2002 | Camp |
| 2005/0218186 | A1 | 10/2005 | Forster |
| 2005/0242154 | A1 | 11/2005 | Leimbach |
| 2008/0054043 | A1 | 3/2008 | Beales |
| 2009/0045241 | A1 | 2/2009 | Fukinuki et al. |
| 2010/0089965 | A1 | 4/2010 | Fukinuki et al. |
| 2010/0089966 | A1 | 4/2010 | Fukinuki et al. |
| 2010/0089967 | A1 | 4/2010 | Fukinuki et al. |
| 2010/0089968 | A1 | 4/2010 | Fukinuki et al. |
| 2010/0089969 | A1 | 4/2010 | Fukinuki et al. |
| 2010/0193562 | A1 | 8/2010 | Fukinuki et al. |

FOREIGN PATENT DOCUMENTS

| | | | |
|---|---|---|---|
| DE | 1109107 | B | 6/1961 |
| EP | 0451976 | A1 | 10/1991 |
| FR | 2534514 | A1 | 4/1984 |
| GB | 446185 | A | 4/1936 |
| GB | 1102888 | A | 2/1968 |
| JP | 2001219383 | A | 8/2001 |
| WO | 8300366 | A1 | 2/1983 |
| WO | 2009021398 | A1 | 2/2009 |
| WO | 2010043178 | A1 | 4/2010 |

OTHER PUBLICATIONS

SENCO Products, Inc., PC0781 Hand Nailer—Parts Reference Guide, Nov. 15, 2000.

IMPACT DEVICE

CROSS-REFERENCE TO RELATED APPLICATIONS

This application claims priority to co-pending U.S. Provisional Patent Application No. 61/306,016 filed on Feb. 19, 2010, the entire content of which is incorporated herein by reference.

FIELD OF THE INVENTION

The present invention relates to power tools, and more particularly to power tools configured for delivering impacts to a fastening element and/or a workpiece.

BACKGROUND OF THE INVENTION

Conventional nail guns typically include a striking pin powered by a source of compressed air for driving nails into a workpiece in a single stroke of the striking pin. Such nail guns often include a cylinder in which the compressed air expands for driving the striking pin and an attached piston. As a result, conventional nail guns are typically bulky, and can be difficult to use in tight work areas where there is not much room to maneuver the nail gun.

SUMMARY OF THE INVENTION

The invention provides, in one aspect, an impact device including a housing, a motor supported by the housing, a stationary shaft defining a longitudinal axis and fixed relative to the housing, and a rotating transmission member drivably coupled to the motor and supported on the stationary shaft for rotation about the longitudinal axis. The rotating transmission member includes a hub having a first cam surface. The impact device also includes a rotating impact member carried by the transmission member and rotatable relative to the transmission member. The rotating impact member includes at least one lug protruding from an outer periphery of the rotating impact member and a second cam surface. The impact device further includes a spherical element engaged with the first and second cam surfaces on the hub of the rotating transmission member and the rotating impact member, respectively, an energy-absorbing member exerting a biasing force against the rotating impact member, and a reciprocating impact member oriented substantially normal to the stationary shaft and impacted by the lug of the rotating impact member.

Other features and aspects of the invention will become apparent by consideration of the following detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
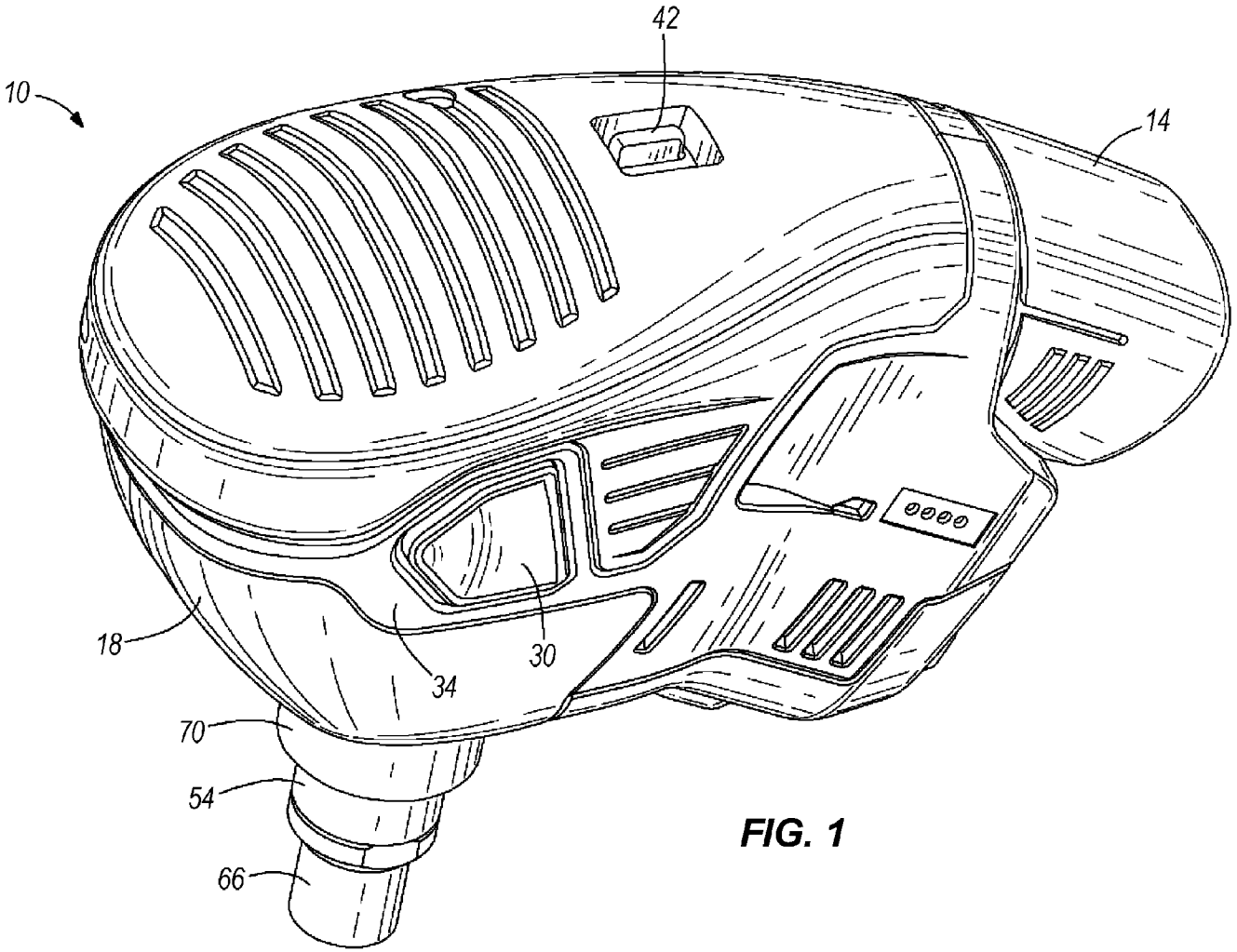
FIG. 1 is a front perspective view of an impact device according to one embodiment of the invention.
Figure 2:
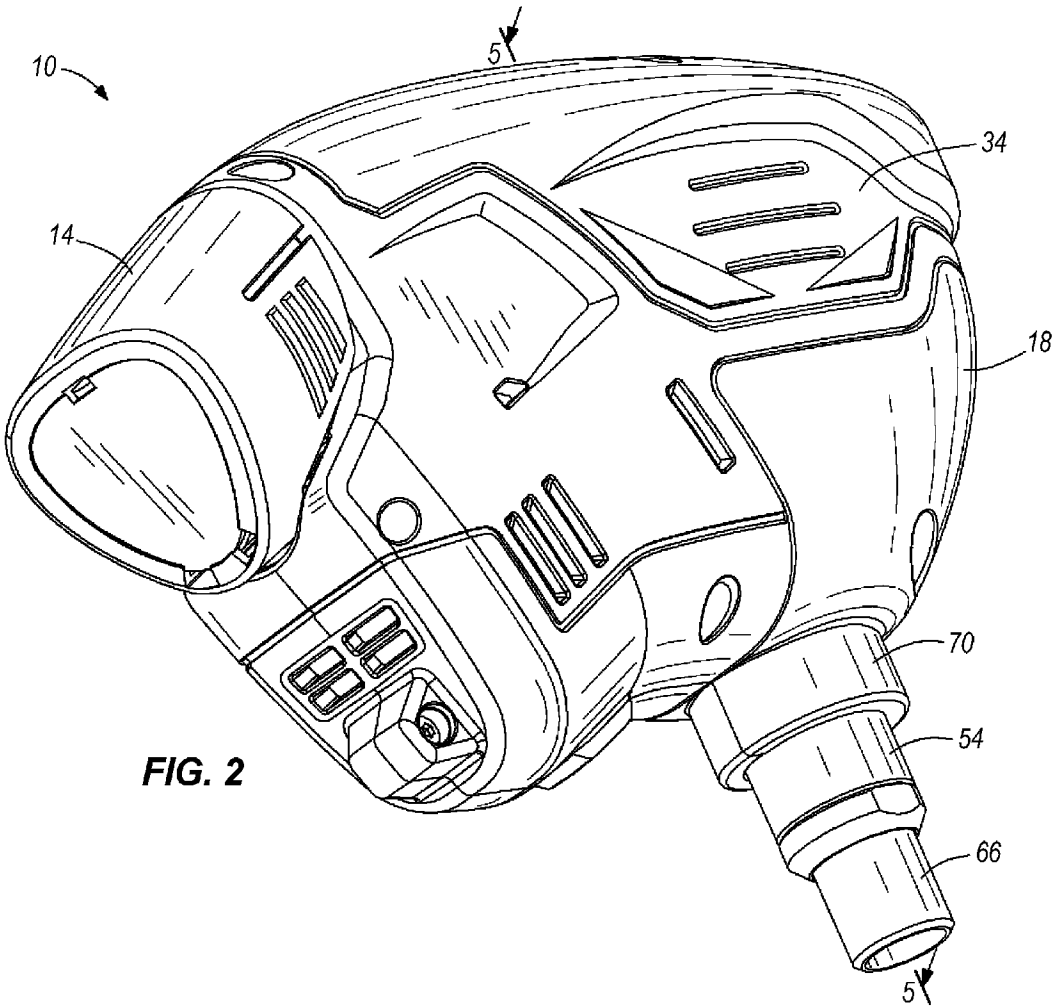
FIG. 2 is a rear perspective view of the impact device of FIG. 1.
Figure 3:
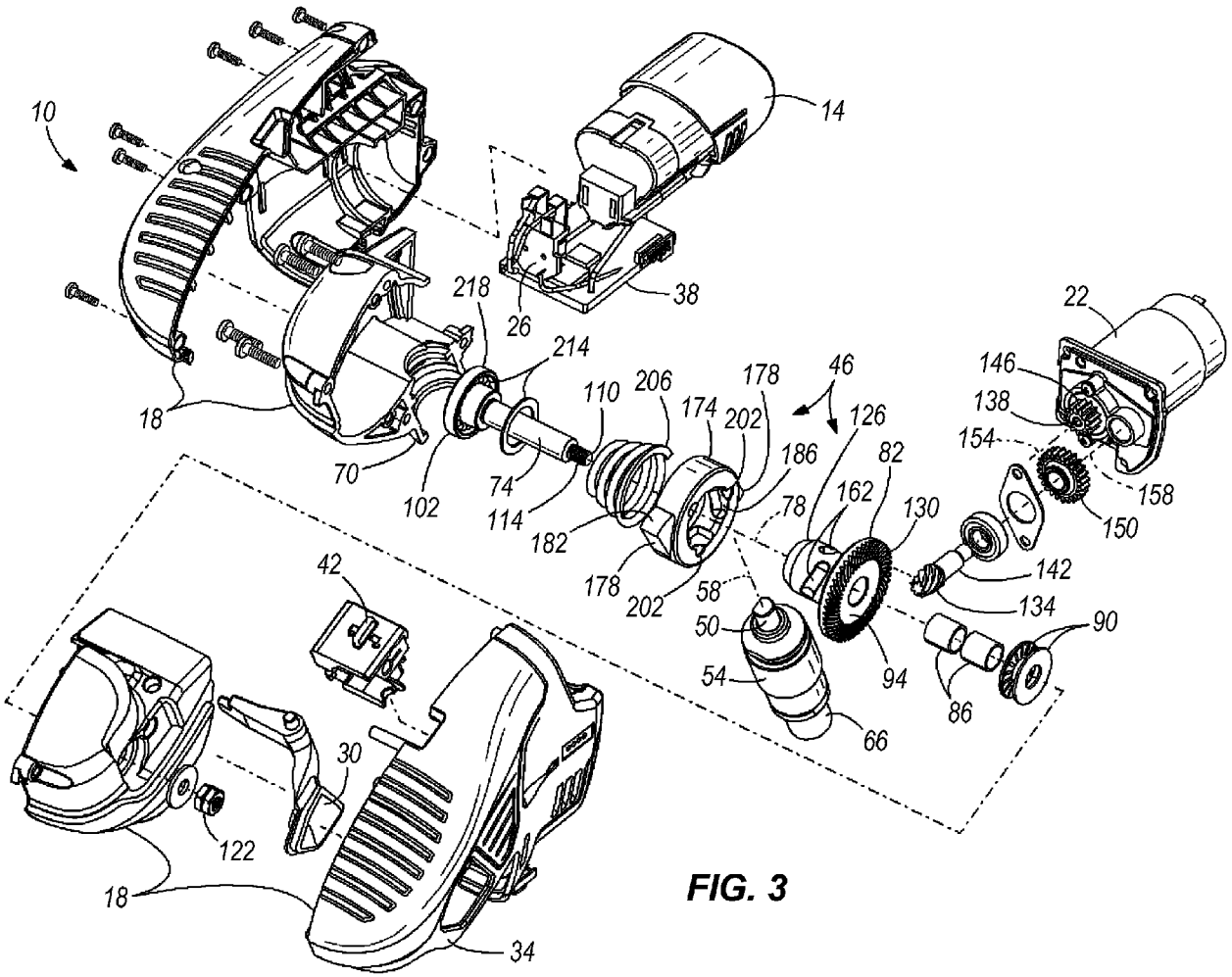
FIG. 3 is an exploded, top perspective view of the impact device of FIG. 1 illustrating an impact assembly.

FIGS. 1-3 illustrate an electrically powered impact or nailing device 10 for driving nails into a workpiece. In the illustrated construction of the nailing device 10, a removable, rechargeable power tool battery 14 is utilized to power the nailing device 10. Alternatively, the battery 14 may be permanently housed within the nailing device 10 and non-removable from the nailing device 10. As a further alternative, the battery 14 may be omitted, and the nailing device 10 may include an electrical cord for connection to an AC power source.

The nailing device 10 includes a housing 18, an electric motor 22 (FIG. 3) supported within the housing 18, a motor-activation switch 26 electrically connected to the motor 22, and a trigger 30 operable to actuate the switch 26 between an open state and a closed state. When the switch 26 is actuated or toggled to the open state, power from the battery 14 is delivered to the motor 22 to activate the motor 22. When the switch 26 is actuated or toggled to the closed state, power from the battery 14 is inhibited from being delivered to the motor 22 to deactivate the motor 22. In the illustrated construction of the nailing device 10 as shown in FIGS. 1 and 2, the housing 18 is shaped to be received or grasped within the palm of an operator's hand with the trigger 30 located on a side wall 34 of the housing 18 to permit the operator to depress the trigger 30 with their thumb. Alternatively, the housing 18 may be configured having any of a number of different shapes.

With reference to FIG. 3, the nailing device 10 also includes a controller 38 electrically connected to the battery 14. The motor-activation switch 26 is electrically connected to the motor 22 through the controller 38. The motor-activation switch 26 includes a toggle 42, which when moved to a locking position inhibits the switch 26 from actuating between the open and closed states, and which when moved to an unlocked position permits the switch 26 to actuate between the open and closed states.

The nailing device 10 further includes an impact mechanism 46 drivably coupled to the motor 22 and a reciprocating impact member or pin 50 (FIG. 5) that is periodically or intermittently impacted by the impact mechanism 46. The pin 50 is at least partially received within a pin housing 54 that guides the pin 50 as it reciprocates about a central axis 58. An O-ring 62 (FIG. 5) positioned in the pin housing 54 slidably engages an outer periphery of the pin 50 while the pin 50 reciprocates within the pin housing 54. The O-ring 62 exerts a small frictional force on the outer periphery of the pin 50 to hold the pin 50 away from the impact mechanism 46 should the nailing device 10 be operated without a reaction force applied to the pin 50 (i.e., by a nail being driven into a workpiece), which would otherwise cause it to move toward the impact mechanism 46. The nailing device 10 relies upon the downward force exerted by the operator of the nailing device 10 to overcome this small frictional force and move the pin 50 toward the impact mechanism 46 between the periodic impacts with the nail. Alternatively, the nailing device 10 may include an energy-absorbing or resilient member (e.g., a spring) that biases or moves the pin 50 toward the impact mechanism 46 between the periodic impacts with the nail.

Figure 5:
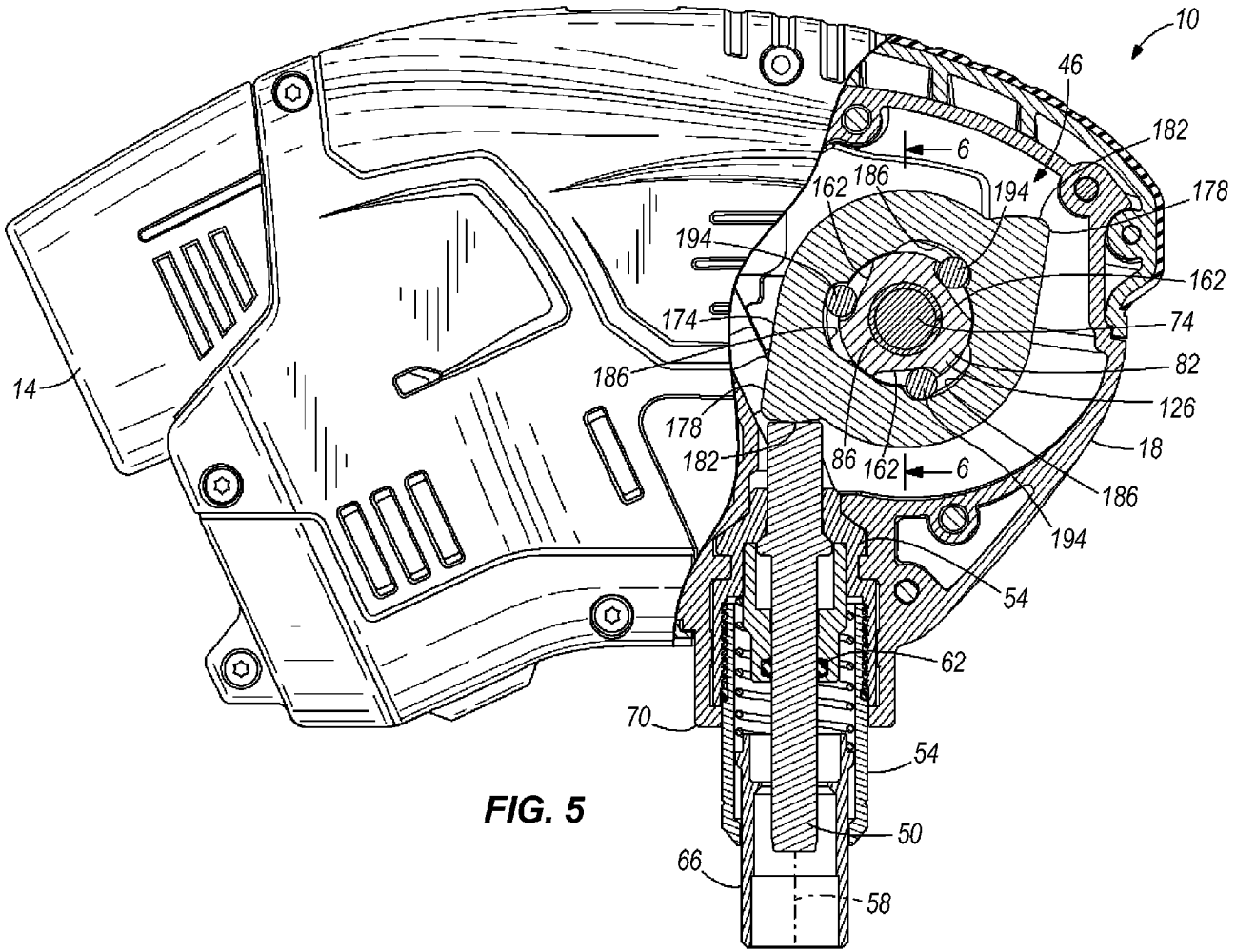
FIG. 5 is a side view of the impact device of FIG. 1, illustrating a partial cutaway of the impact device to expose the impact mechanism of FIG. 3.

With reference to FIG. 5, the nailing device 10 also includes a sleeve 66 that surrounds the pin 50. In operation of the nailing device 10, the sleeve 66 is retractable into the pin housing 54 and a nose portion 70 of the housing 18 to enable the pin 50 to drive a nail flush into a workpiece. The nailing device 10 may also include a magnet incorporated within the sleeve 66 and/or the pin housing 54 with which to retain the head or another portion of the nail in preparation for driving the nail into a workpiece.

Figure 4:
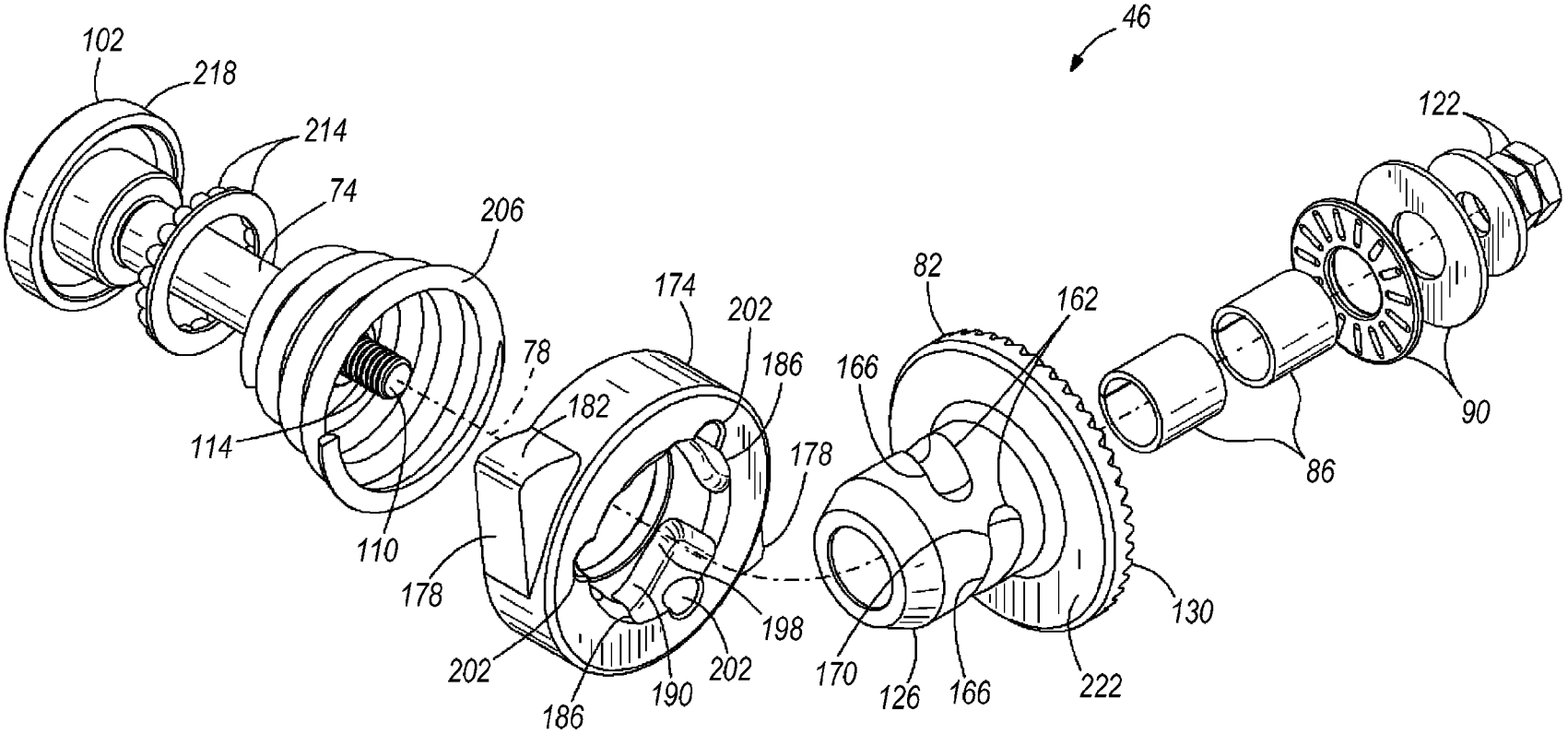
FIG. 4 is an exploded perspective view of the impact mechanism of FIG. 3, illustrating a rotating transmission member and a rotating impact member carried by the transmission member.
Figure 6:
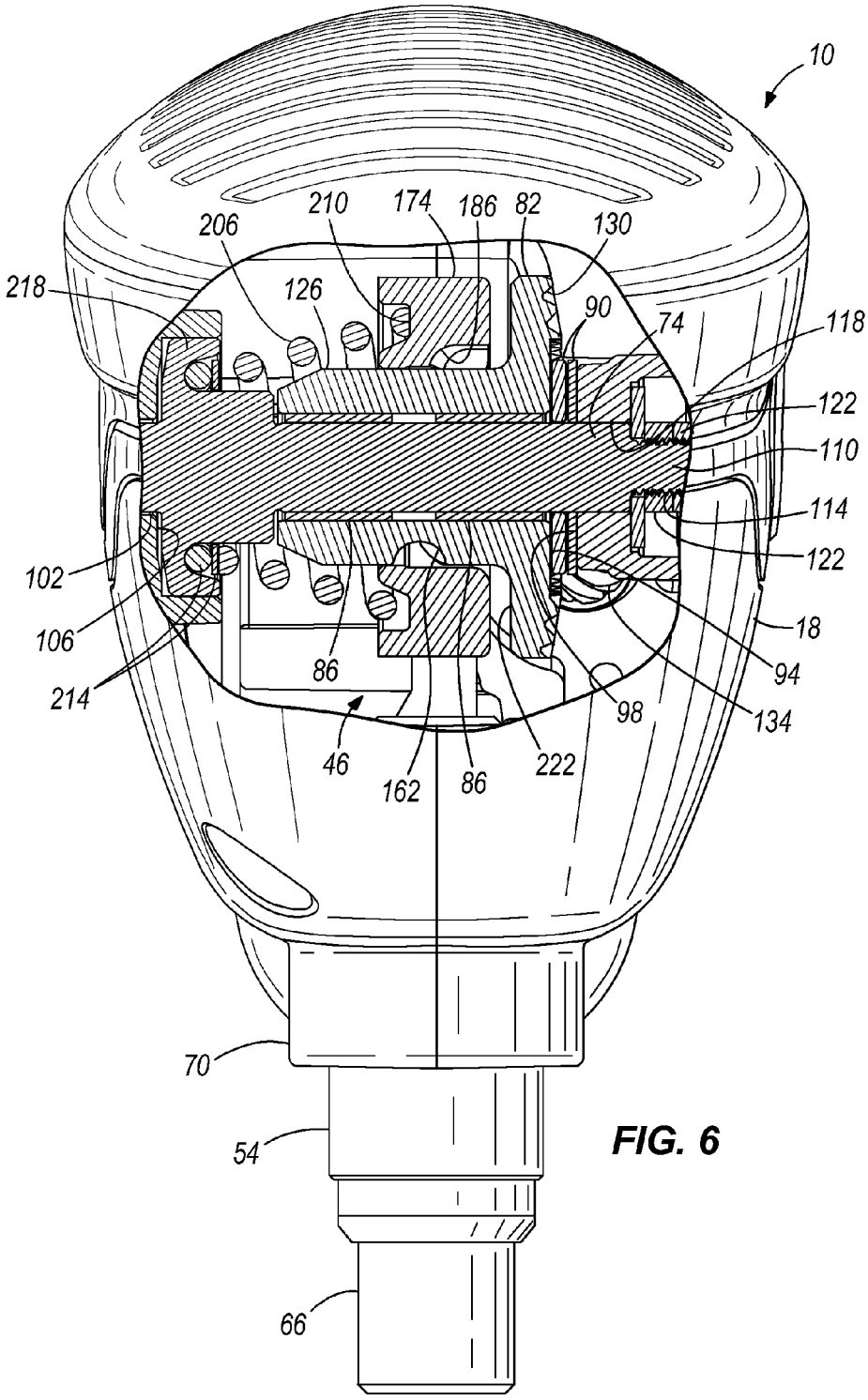
FIG. 6 is a front view of the impact device of FIG. 1, illustrating a partial cutaway of the impact device to expose the impact mechanism of FIG. 3.

With reference to FIGS. 3, 4, and 6, the impact mechanism 46 includes a stationary support shaft 74 defining a longitudinal axis 78 and fixed to the housing 18, and a rotating transmission member in the form of a bevel gear 82 supported on the stationary support shaft 74 for rotation relative to the shaft 74 about the longitudinal axis 78. Two spaced bushings 86 are positioned between the bevel gear 82 and the stationary support shaft 74, adjacent each end of the bevel gear 82, to facilitate rotation of the bevel gear 82 relative to the stationary support shaft 74. Alternatively, any of a number of different bearings or bushings may be utilized between the bevel gear 82 and the stationary support shaft 74. A thrust bearing 90 is also positioned on a front surface 94 of the bevel gear 82 to facilitate the transfer of axial loading on the bevel gear 82 (e.g., loading caused by the biasing force of the spring 206, discussed in more detail below) to an interior face 98 of the housing 18 (FIG. 6).

Figure 8:
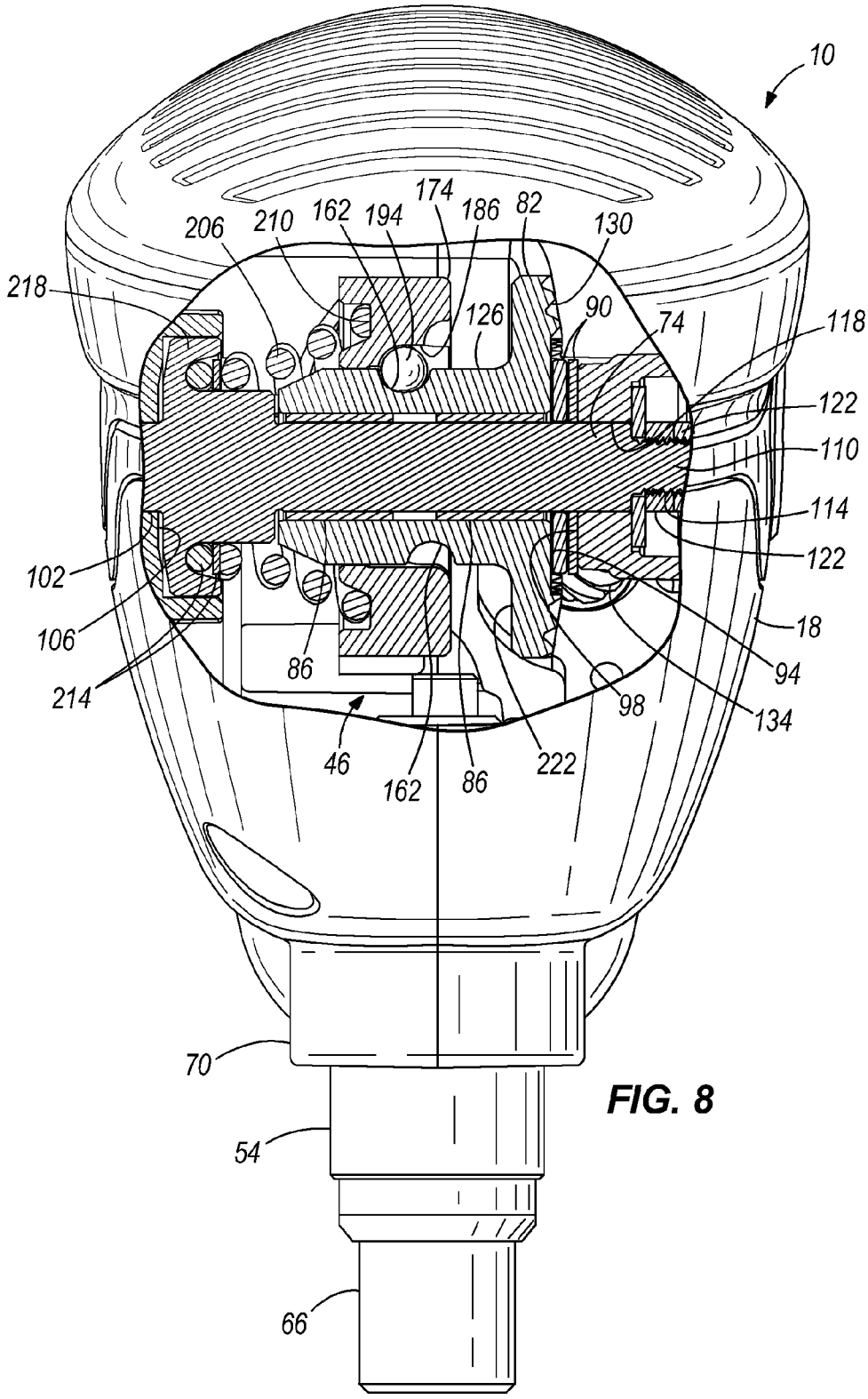
FIG. 8 is a front view of the impact device of FIG. 1, illustrating a partial cutaway of the impact device to expose the impact mechanism of FIG. 3.

As shown in FIGS. 6 and 8, the stationary support shaft 74 includes a first end 102 positioned adjacent an interior face 106 of the housing 18 and a second end 110 having a threaded outer periphery 114. The second end 110 of the stationary support shaft 74 is inserted through an aperture 118 in the housing 18, and a threaded fastener (e.g., one or more jam nuts 122) is threaded to the threaded outer periphery 114 to secure the stationary support shaft 74 relative to the housing 18 such that the stationary support shaft 74 is inhibited from moving along the longitudinal axis 78 or rotating about the longitudinal axis 78.

With reference to FIGS. 3 and 4, the bevel gear 82 includes a hub 126 and a toothed portion 130 engaged with a pinion 134 (FIG. 3) which, in turn, is driven by an output shaft 138 of the motor 22. In the illustrated construction of the nailing device 10, the pinion 134 is incorporated on an intermediate shaft 142 offset from the output shaft 138 of the motor 22, and a spur gear arrangement (including a first spur gear 146 mounted to the motor output shaft 138 and a second spur gear 150 mounted to the intermediate shaft 142) is utilized between the motor output shaft 138 and the intermediate shaft 142. The spur gears 146, 150 are sized to reduce the rotational speed of the intermediate shaft 142 and the pinion 134 with respect to the rotational speed of the motor output shaft 138. The nailing device 10 may alternatively incorporate any of a number of different transmissions for transferring torque from the motor output shaft 138 to the bevel gear 82. Also, in the illustrated construction of the nailing device 10 as shown in FIG. 3, the motor output shaft 138 and the intermediate shaft 142 are rotatable about respective axes 154, 158, each of which is oriented substantially normal to the longitudinal axis 78.

Figure 9A:
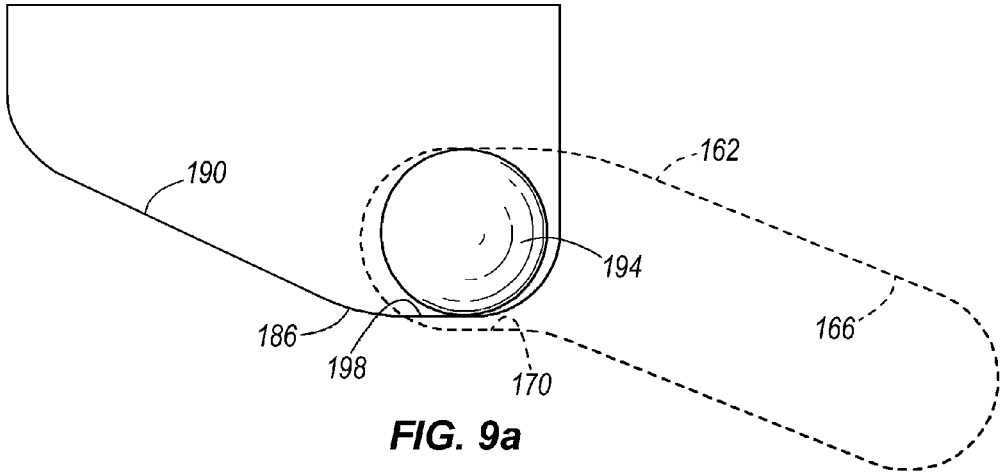
FIG. 9*a* is a schematic illustrating engaged cam surfaces of the rotating transmission member and the rotating impact member, respectively, of the impact mechanism of FIG. 3 correlating with the position of the rotating impact member relative to the rotating transmission member as shown in FIG. 6.
Figure 9B:
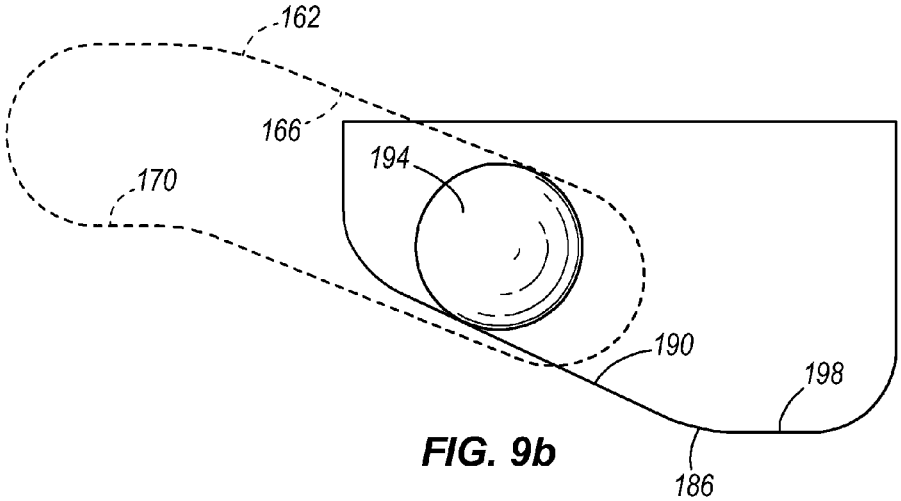
FIG. 9*b* is a schematic illustrating engaged cam surfaces of the rotating transmission member and the rotating impact member, respectively, of the impact mechanism of FIG. 3 correlating with the position of the rotating impact member relative to the rotating transmission member as shown in FIG. 8.

With reference to FIG. 4, the bevel gear 82 includes a plurality of cam tracks or surfaces 162 spaced about the outer periphery of the hub 126. In the illustrated construction of the impact mechanism 46, three cam surfaces 162 are formed on the outer periphery of the hub 126. Alternatively, more or fewer than three cam surfaces 162 may be employed. Each of the cam surfaces 162 includes a first or inclined portion 166 that is inclined in a single direction with respect to the longitudinal axis 78 about which the bevel gear 82 rotates (FIGS. 9*a* and 9*b*). In other words, the inclined portion 166 of each of the cam surfaces 162 appears substantially straight in a plan view of the bevel gear 82. Each of the cam surfaces 162 also includes a second portion or a landing region 170 that is non-inclined with respect to the longitudinal axis 78. In other words, the landing region 170 of each of the cam surfaces 162 appears substantially transverse to the longitudinal axis 78 in a plan view of the bevel gear 82.

With reference to FIGS. 3 and 4, the impact mechanism 46 also includes a rotating impact member or hammer 174 carried by the bevel gear 82. The hammer 174 includes dual lugs 178 (FIG. 10) extending from the outer periphery of the hammer 174 and angularly spaced from each other by about 180 degrees. Alternatively, the hammer 174 may only include only a single lug 178, or more than two lugs 178. Each of the lugs 178 includes an impact surface 182, having an involute profile, that periodically or intermittently impacts the pin 50 during operation of the nailing device 10. The involute profile of each of the impact surfaces 182 is based upon or derived from a hypothetical base cylinder (Rb; FIG. 11) having a radius centered on the axis 78. The curvature of each of the impact surfaces 182 on the lugs 178 is traced by a point on an imaginary, taut thread or cord as it is unwound from the hypothetical base cylinder Rb in a counterclockwise direction, thereby generating the involute profile of the impact surfaces 182.

Figure 11:
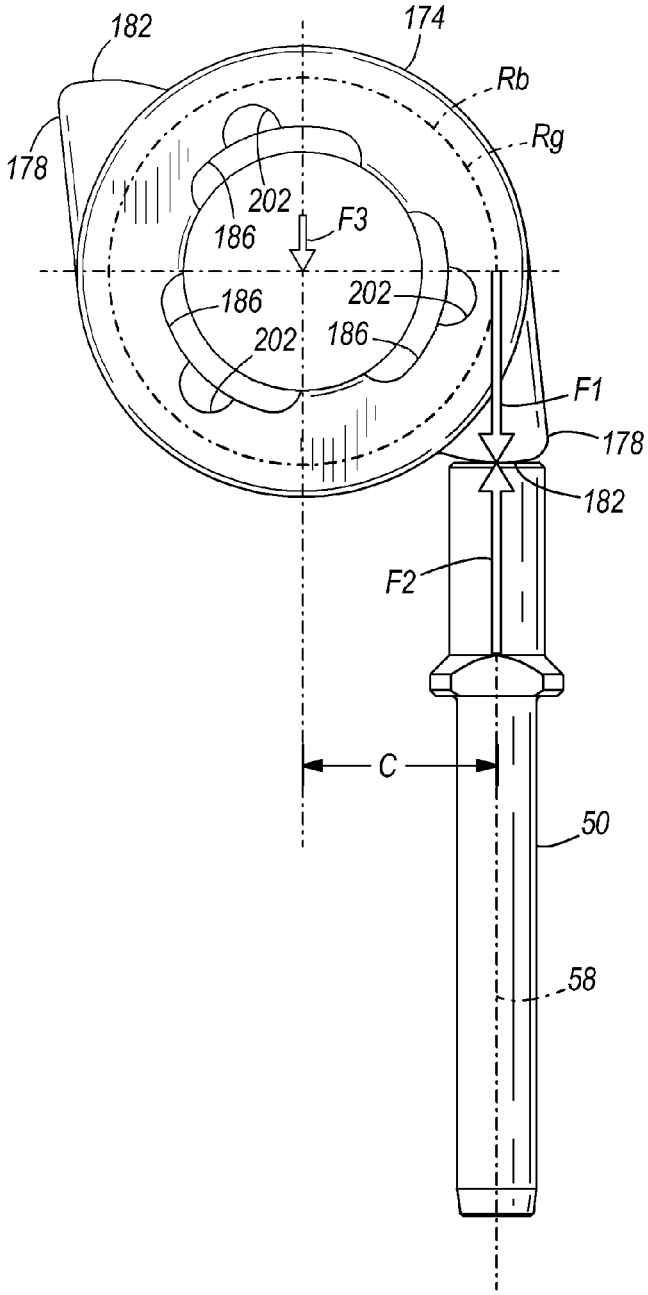
FIG. 11 is a side view of the rotating impact member of the impact mechanism of FIG. 3, impacting a reciprocating impact member of the impact device.
Figure 12:
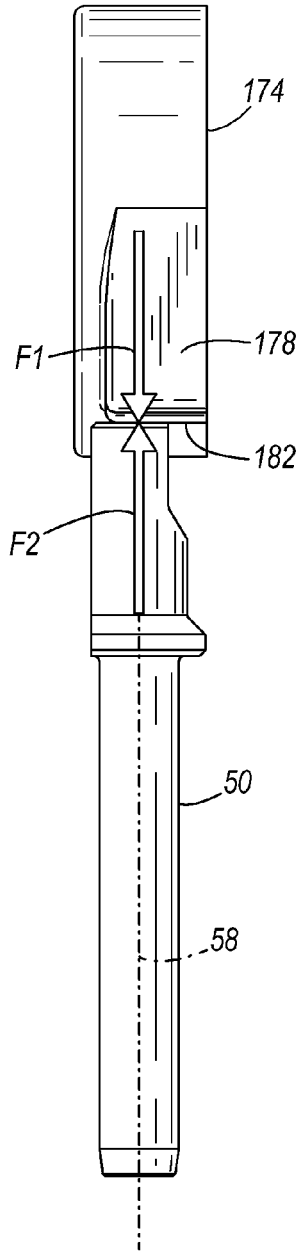
FIG. 12 is a front view of the rotating impact member and the reciprocating impact member of FIG. 11.

With reference to FIGS. 11 and 12, one of the lugs 178 on the hammer 174 is shown impacting the pin 50. During impact, the forces acting on the lug 178 and the pin 50 are directed along a line of action that is normal to both the impacted top surface of the pin 50 and the impact surface 182 of the lug 178. As shown in FIG. 11, any line that is normal to the involute impact surface 182 is also tangent to the hypothetical base cylinder Rb used in tracing the shape of the impact surface 182.

The hammer 174 is also designed such that its radius of gyration (designated Rg in FIG. 11) substantially coincides with the radius of the hypothetical base cylinder Rb used in tracing the shape of the impact surface 182. The radius of gyration Rg of the hammer 174 is the point about which the mass of the hammer 174 can be concentrated without changing the hammer's moment of inertia. In other words, the hammer 174 can be illustrated in a free body diagram as a point mass rotating about the axis 78 at a radius of Rg, such that the impact force (designated F1 in FIGS. 11 and 12) delivered by the hammer 174 occurs along a line of action tangent to the radius of gyration Rg of the hammer 174. Because the radius of gyration Rg substantially coincides with the radius of the hypothetical base cylinder Rb used in tracing the shape of the impact surface 182, the impact force F1 and the reaction force (designated F2 in FIGS. 11 and 12) of the pin 50 on the impact surface 182 occur along the same line of action, which is coaxial with the central axis 58 and passes through the center of gravity of the pin 50. As a result, the impact force F1 delivered to the pin 50, and the reaction force F2 of the pin 50 on the lug 178, are substantially equal in magnitude and opposite in direction. Therefore, any reaction forces (designated F3 in FIG. 11) exerted by the hammer 174 (e.g., on the stationary support shaft 74) are minimized or eliminated. The efficiency of the nailing device 10 is therefore increased because less force (and therefore less energy) is transferred to the housing 18 (via the stationary support shaft 74) during each impact of the lugs 178 and the pin 50.

Should the involute profiles of the impact surfaces 182 be replaced with non-involute impacting features, there would be no fixed line of action along which the impact force F1 of the hammer 174 is delivered to the pin 50. Moreover, if the radius of gyration Rg of the hammer 174, involute base cylinder radius Rb, and center distance C (between the axes 78, 58 of the hammer 174 and the pin 50, respectively) are not substantially equal, the impact force F1 of the hammer 174 would not align with the reaction force F2 of the pin 50, resulting in a potentially sizeable reaction force F3 between the hammer 174 and the stationary support shaft 74. Such a reaction force would ultimately reduce the efficiency of the nailing device 10 in which the hammer 174 is used because more force (and therefore more energy) would be transferred or lost to the stationary support shaft 74 and the housing 18 during each impact between the lugs (with the non-involute profiles) and the pin 50.

The involute profile of each of the impact surfaces 182 is similar to the involute profile of the ram lugs of the impact wrench shown and described in published PCT Patent Application No. WO 2009/137684, the entire content of which is incorporated herein by reference.

Figure 10:
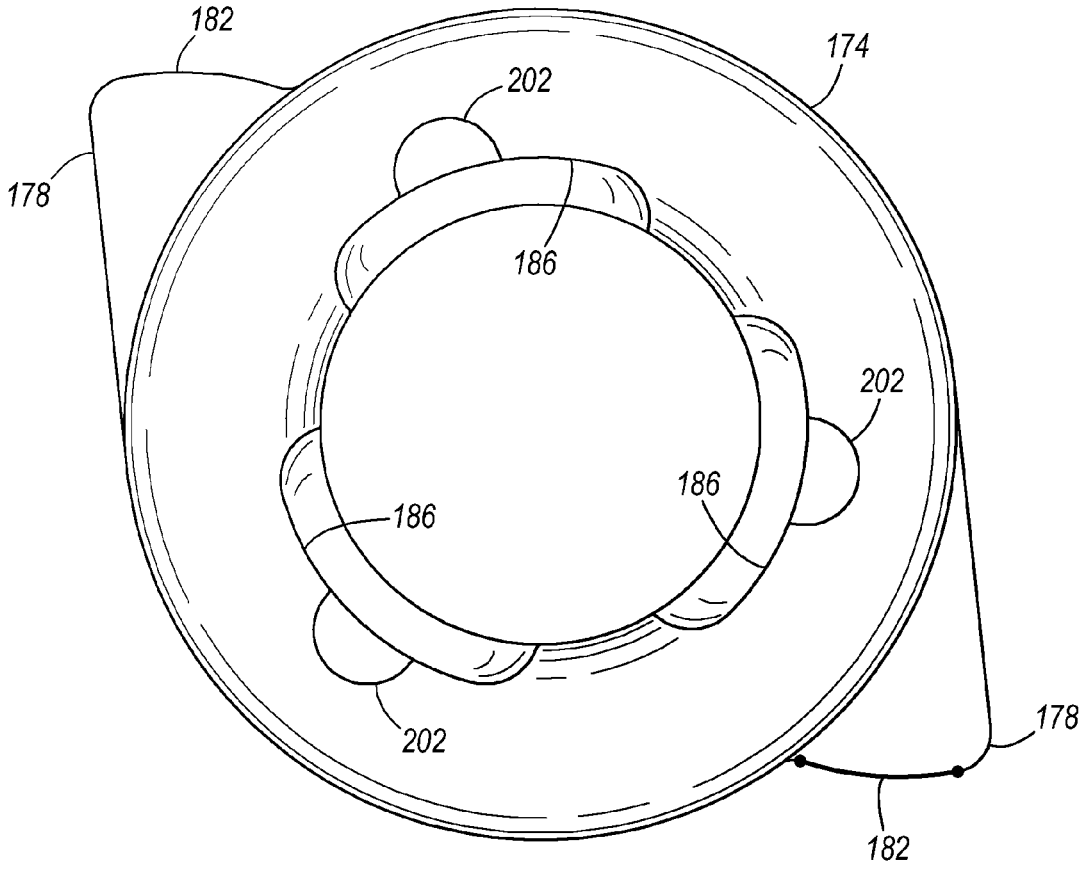
FIG. 10 is a side view of the rotating impact member of the impact mechanism of FIG. 3.

With reference to FIGS. 4 and 10, the hammer 174 also includes a plurality of cam tracks or surfaces 186 spaced about the inner periphery of the hammer 174. In the illustrated construction of the impact mechanism 46, three cam surfaces 186 are formed on the inner periphery of the hammer 174 corresponding with the three cam surfaces 162 on the bevel gear 82. Alternatively, fewer or more than three cam surfaces 186 may be employed, depending upon the number of cam surfaces 162 on the bevel gear 82. Each of the cam surfaces 186 includes a first or inclined portion 190 that is inclined in a single direction with respect to the longitudinal axis 78 about which the hammer 174 rotates. Particularly, the inclined portions 166, 190 of the cam surfaces 162, 186 of the bevel gear 82 and the hammer 174, respectively, are inclined in opposite directions such that when a spherical element (e.g., a ball bearing 194, see FIGS. 9*a* and 9*b*) is positioned between each pair of cam surfaces 162, 186, the hammer 174 is axially displaced or moved along the longitudinal axis 78 in response to relative rotation between the bevel gear 82 and the hammer 174.

With continued reference to FIGS. 9*a* and 9*b*, each of the cam surfaces 186 includes a second portion or a landing region 198 in which the cam surface 186 is non-inclined with respect to the longitudinal axis 78. In other words, the landing region 198 in each of the cam surfaces 186 appears substantially transverse to the longitudinal axis 78 in a plan view of the hammer 174. The hammer 174 also includes a relief 202 (FIG. 10) formed adjacent each of the cam surfaces 186 to facilitate insertion of the ball bearings 194 between the hammer 174 and the bevel gear 82 during assembly of the nailing device 10.

With reference to FIGS. 3 and 4, the impact mechanism 46 includes an energy-absorbing or resilient member (e.g., a compression spring 206) positioned between the hammer 174 and a portion of the stationary support shaft 74. Particularly, one end of the spring 206 is seated within a pocket 210 formed in the hammer 174 (FIGS. 6 and 8), while the other end of the spring 206 is abutted against a thrust bearing 214 which, in turn, is seated against a shoulder 218 of the stationary support shaft 74. As is explained in detail below, the thrust bearing 214 permits the spring 206 to co-rotate with the hammer 174, without winding the spring 206, while the nailing device 10 is in use. Because the spring 206 is pre-loaded during assembly of the nailing device 10, the spring 206 continuously exerts a biasing force against the hammer 174 and the interior face 98 of the housing 18 (i.e., via the hammer 174, the ball bearings 194, the bevel gear 82, and the thrust bearing 90). In the illustrated construction of the impact mechanism 46, the spring 206 is conical in shape. Alternatively, the spring 206 may be cylindrical in shape.

In operation of the nailing device 10, the user first inserts a nail, with the head of the nail facing the impacting end of the pin 50, within the sleeve 66. If included, the magnet attracts the nail toward one side of the sleeve 66 to retain the nail within the sleeve 66 without additional assistance from the user. The user then holds the nailing device 10 to position the tip of the nail against a workpiece, and energizes the motor 22 by depressing the trigger 30. The torque from the motor 22 is transferred to the intermediate shaft 142 to rotate the pinion 134, the bevel gear 82, and the hammer 174 about the longitudinal axis 78.

Prior to the first impact between the hammer 174 and the pin 50 (FIGS. 5 and 6), torque is transferred from the bevel gear 82 to the hammer 174 via the respective cam surfaces 162 and the ball bearings 194 engaging the respective cam surfaces 186 in the hammer 174, causing the hammer 174 to co-rotate with the bevel gear 82. Particularly, the biasing force exerted by the spring 206 causes the ball bearings 194 to wedge against the pairs of cam surfaces 162, 186 to assure co-rotation of the bevel gear 82 and the hammer 174. As a result, the axial position of the hammer 174 with respect to the longitudinal axis 78 remains unchanged. FIG. 9*a* illustrates the position of each of the ball bearings 194 within the respective pairs of cam surfaces 162, 186 on the bevel gear 82 and the hammer 174, coinciding with the position of the hammer 174 relative to the bevel gear 82 as shown in FIGS. 5 and 6. As previously mentioned, the thrust bearing 214 permits the spring 206 to co-rotate with the hammer 174 without winding the spring 206.

Figure 7:
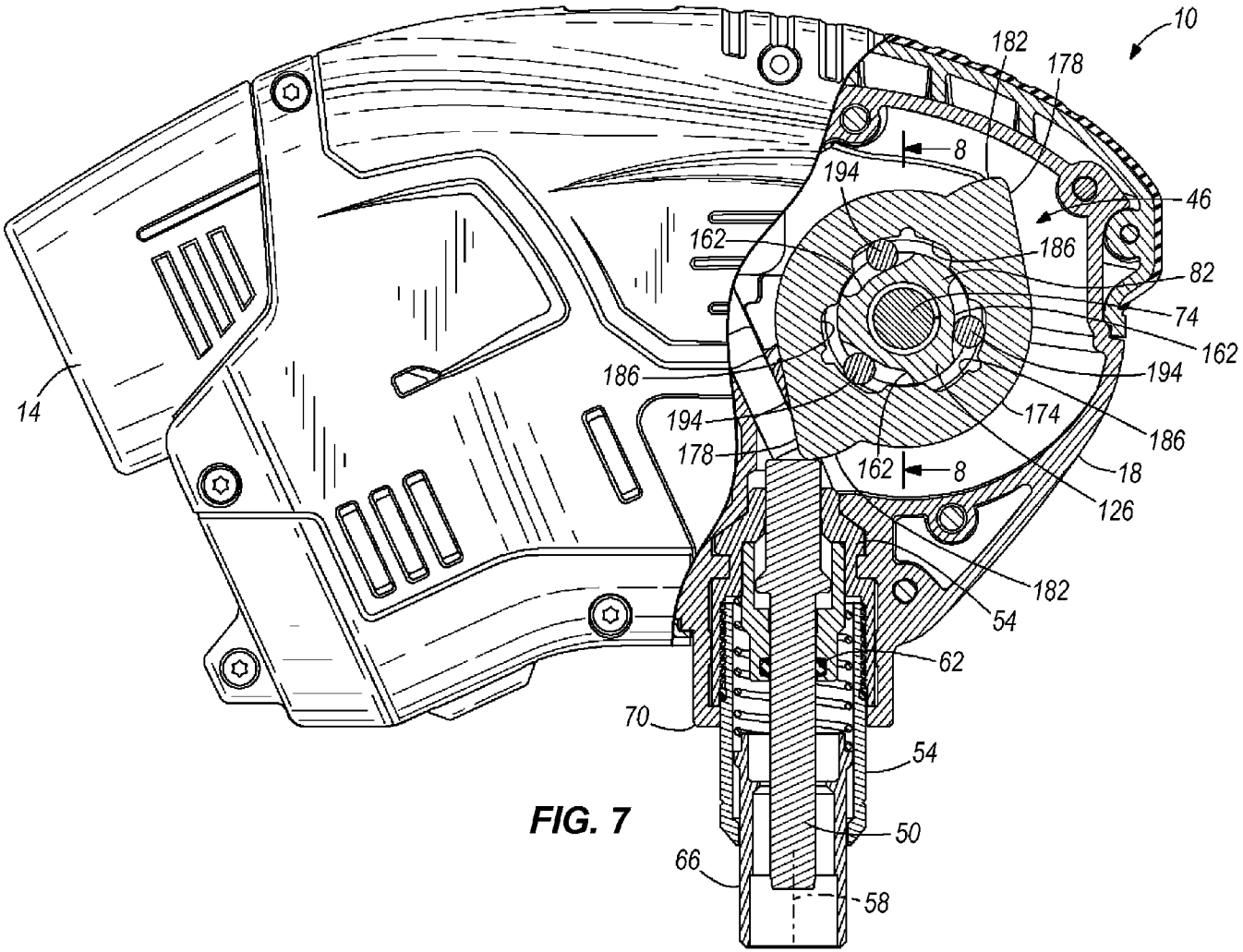
FIG. 7 is a side view of the impact device of FIG. 1, illustrating a partial cutaway of the impact device to expose the impact mechanism of FIG. 3.

However, in response to the first impact between the hammer 174 and the pin 50, the impacting lug 178 and the pin 50 move together an incremental amount corresponding to an incremental length of the nail that is driven into the workpiece during that particular forward stroke (i.e., toward the workpiece) of the pin 50. The incremental amount that the nail is driven into the workpiece is dependent upon the magnitude of the resistance or friction between the nail and the workpiece. After the nail has been driven into the workpiece by a first incremental amount, the nail seizes, effectively stopping the forward stroke of the pin 50 and the accompanying rotation of the hammer 174. The bevel gear 82, however, continues to rotate with respect to the hammer 174, causing the hammer 174 to move axially along the bevel gear 82 and the longitudinal axis 78 against the bias of the spring 206 to compress the spring 206, as a result of the ball bearings 194 rolling over the respective pairs of cam surfaces 162, 186. FIG. 9*b* illustrates the position of each of the ball bearings 194 within the respective pairs of cam surfaces 162, 186 on the bevel gear 82 and the hammer 174, coinciding with the position of the hammer 174 relative to the bevel gear 82 as shown in FIGS. 7 and 8.

Axial displacement of the hammer 174 continues to occur so long as the hammer 174 is prevented from rotating with the bevel gear 82. After the hammer 174 is moved a sufficient amount to clear the lug 178 from the end of the pin 50 (FIG. 8), the hammer 174 resumes rotation with the bevel gear 82 and is rotationally accelerated about the longitudinal axis 78 by the stored energy from the spring 206 as it resumes its pre-loaded shape. Particularly, as the spring 206 decompresses and resumes its pre-loaded shape, the ball bearings 194 roll in an opposite direction over the respective pairs of cam surfaces 162, 186 to allow the spring 206 to push the hammer 174 along the longitudinal axis 78 toward a back surface 222 of the bevel gear 82 in preparation for a second impact between the hammer 174 and the pin 50.

The landing regions 170, 198 in each of the cam surfaces 162, 186, respectively, permit the hammer 174 to continue rotating about the axis 78, relative to the bevel gear 82, after the axial movement of the hammer 174 is completed and prior to the second impact with the pin 50. As a result, the landing regions 170, 198 in the respective cam surfaces 162, 186 permit the hammer 174 to strike the pin 50 during the second impact without stopping or decelerating the rotation of the hammer 174 relative to the hub 126 of the bevel gear 82, which might otherwise occur when the ball bearings 194 reach the ends of the respective cam surfaces 162, 186. Consequently, the stored energy in the spring 206 is substantially fully transferred from the hammer 174 to the pin 50 during the second and subsequent impacts. During the second impact, the nail is driven into the workpiece a second incremental amount. The nailing device 10 continues to drive the nail into the workpiece in this manner until the head of the nail is substantially flush with the workpiece. As mentioned above, the sleeve 66 retracts into the nose portion 70 of the housing 18 during a nail-driving operation to permit the nail to be driven substantially flush into the workpiece.

Although the impact mechanism 46 is shown in conjunction with the nailing device 10, it should also be understood that the impact mechanism 46 may also be used with other impact-related power tools. For example, the impact mechanism 46 may be incorporated in a chisel, a tail pipe cutter, a straight-sheet metal cutter, a punch, a scraper, and a pick.

Various features of the invention are set forth in the following claims.

What is claimed is:

1. A impact device comprising:

a housing;

a motor supported by the housing;

a stationary shaft defining a longitudinal axis and fixed relative to the housing;

a rotating transmission member drivably coupled to the motor and supported on the stationary shaft for rotation about the longitudinal axis, the rotating transmission member including a hub having a first cam surface;

a rotating impact member carried by the transmission member and rotatable relative to the transmission member, the rotating impact member including at least one lug protruding from an outer periphery of the rotating impact member and a second cam surface;

a spherical element engaged with the first and second cam surfaces on the hub of the rotating transmission member and the rotating impact member, respectively;

an energy-absorbing member exerting a biasing force against the rotating impact member; and a reciprocating impact member oriented substantially normal to the stationary shaft and impacted by the lug of the rotating impact member.

2. The nailing device of claim 1, wherein the spherical element and the first and second cam surfaces are configured to displace the rotating impact member along the longitudinal axis, against the biasing force of the energy-absorbing member, in response to relative rotation between the rotating transmission member and the rotating impact member.

3. The impact device of claim 2, wherein the relative rotation between the rotating transmission member and the rotating impact member is caused by the lug impacting the reciprocating impact member.

4. The impact device of claim 1, wherein at least a portion of the first cam surface is inclined in a first direction with respect to the longitudinal axis, wherein at least a portion of the second cam surface is inclined in a second direction with respect to the longitudinal axis, and wherein the first and second directions are substantially parallel.

5. The impact device of claim 1, wherein the first cam surface includes a first portion inclined with respect to the longitudinal axis and a second portion oriented substantially normal to the longitudinal axis.

6. The impact device of claim 5, wherein the second cam surface includes a first portion inclined with respect to the longitudinal axis and a second portion oriented substantially normal to the longitudinal axis.

7. The impact device of claim 6, wherein the rotating impact member is axially displaceable along the stationary shaft between a first position, in which the spherical element is positioned within the second portion of each of the first and second cam surfaces, and a second position, in which the spherical element is positioned within the first portion of each of the first and second cam surfaces.

8. The impact device of claim 7, wherein axial displacement of the rotating impact member relative to the stationary shaft does not occur in response to relative rotation between the rotating transmission member and the rotating impact member when the spherical element is moving within the second portion of each of the first and second cam surfaces.

9. The impact device of claim 8, wherein axial displacement of the rotating impact member relative to the stationary shaft occurs in response to relative rotation between the rotating transmission member and the rotating impact member when the spherical element is moving within the first portion of each of the first and second cam surfaces.

10. The impact device of claim 1, wherein the stationary shaft includes a shoulder, and wherein the energy-absorbing member is positioned between the rotating impact member and the shoulder.

11. The impact device of claim 1, wherein the motor includes a motor output shaft oriented substantially normal to the longitudinal axis.

12. The impact device of claim 11, further comprising a transmission coupled between the motor output shaft and the rotating transmission member.

13. The impact device of claim 12, wherein the transmission includes an intermediate shaft offset from the motor output shaft and oriented substantially normal to the longitudinal axis.

14. The impact device of claim 13, wherein the transmission further includes a first spur gear coupled for co-rotation with the motor output shaft, and a second spur gear coupled for co-rotation with the intermediate shaft and engaged with the first spur gear.

15. The impact device of claim 14, wherein the first spur gear includes a first plurality of teeth and the second spur gear includes a second plurality of teeth, and wherein the second plurality of teeth is greater than the first plurality of teeth.

16. The impact device of claim 14, wherein the intermediate shaft includes a pinion integrally formed therewith, and wherein the rotating transmission member includes a toothed portion engaged with the pinion.

17. The impact device of claim 1, wherein the lug includes an impact surface intermittently engageable with the reciprocating impact member, and wherein the impact surface includes an involute profile.

18. The impact device of claim 1, further comprising a motor-activation switch electrically connected to the motor, and a trigger operable to actuate the switch between an open state and a closed state, wherein the trigger is located on a side wall of the housing.

19. The impact device of claim 18, further comprising a battery supported by the housing, and a controller electrically connected to the battery, wherein the motor-activation switch is electrically connected to the motor through the controller.

20. The impact device of claim 18, wherein the motor-activation switch includes a toggle which when moved to a locking position inhibits the switch from actuating between the open and closed states, and which when moved to an unlocked position permits the switch to actuate between the open and closed states.

* * * * *